US009993831B2

(12) United States Patent
Pasol et al.

(10) Patent No.: US 9,993,831 B2
(45) Date of Patent: Jun. 12, 2018

(54) CENTRIFUGE AND DISCHARGE PORT MEMBER OF A CENTRIFUGE FOR POWER REDUCTION

(75) Inventors: Laurentiu Pasol, Paris (FR); Jean-Marc Huyghe, Le Poinconnet (FR)

(73) Assignee: Andritz S.A.S., F-Velizy-Villacoublay (FR)

( * ) Notice: Subject to any disclaimer, the term of this patent is extended or adjusted under 35 U.S.C. 154(b) by 570 days.

(21) Appl. No.: 14/235,601

(22) PCT Filed: Jul. 26, 2012

(86) PCT No.: PCT/EP2012/003159
§ 371 (c)(1),
(2), (4) Date: May 8, 2014

(87) PCT Pub. No.: WO2013/017223
PCT Pub. Date: Feb. 7, 2013

(65) Prior Publication Data

US 2014/0235423 A1 Aug. 21, 2014

(30) Foreign Application Priority Data

Jul. 29, 2011 (EP) ..... 11006271

(51) Int. Cl.
*B04B 11/02* (2006.01)
*B04B 1/20* (2006.01)

(52) U.S. Cl.
CPC ..... *B04B 11/02* (2013.01); *B04B 1/20* (2013.01); *B04B 2001/2075* (2013.01); *B04B 2001/2083* (2013.01)

(58) Field of Classification Search
CPC ... B04B 1/20; B04B 11/02; B04B 2001/2083; B04B 2001/2075
USPC ..... 494/43, 56
See application file for complete search history.

(56) References Cited

U.S. PATENT DOCUMENTS 5,156,751 A * 10/1992 Miller ..... B04B 1/20 210/178
5,618,409 A * 4/1997 Kreill ..... B04B 1/14 210/149
2004/0072668 A1* 4/2004 Leung ..... B04B 1/20 494/56

(Continued)

FOREIGN PATENT DOCUMENTS

CN 1691985 A 11/2005
CN 101715370 A 5/2010

(Continued)

*Primary Examiner* — Walter D Griffin
*Assistant Examiner* — Shuyi S Liu
(74) *Attorney, Agent, or Firm* — Alix, Yale & Ristas, LLP

(57) ABSTRACT

A rotating machine has a bowl that is rotatable about an axis to generate a cylindrical pool of a feed slurry. The bowl has a heavy phase discharge port and a base plate at one longitudinal end of the bowl. There is at least one outlet opening in the base plate and a liquid phase discharge port member positioned over the outlet opening. The liquid phase discharge port member includes at least one open straight channel having a longitudinal axis that extends at an acute angle relative to the base plate. The channel has an extension in the direction of the longitudinal axis of open straight channel.

20 Claims, 8 Drawing Sheets

(56) References Cited

U.S. PATENT DOCUMENTS

| | | | | |
|---|---|---|---|---|
| 2005/0164861 | A1* | 7/2005 | Bruning | B04B 1/20 494/56 |
| 2011/0039680 | A1* | 2/2011 | Madsen | B04B 1/20 494/56 |

FOREIGN PATENT DOCUMENTS

| | | | | |
|---|---|---|---|---|
| CN | 202105728 | U | 1/2012 | |
| WO | WO 2008138345 | A1 * | 11/2008 | B04B 1/20 |

* cited by examiner

CENTRIFUGE AND DISCHARGE PORT MEMBER OF A CENTRIFUGE FOR POWER REDUCTION

CROSS-REFERENCE TO RELATED APPLICATIONS

This is the national stage of International Application No. PCT/EP2012/003159 filed Jul. 26, 2012.

BACKGROUND

The invention relates to a rotating machine comprising a bowl rotatable about an axis to generate a cylindrical pool of a feed slurry, said bowl having a heavy phase discharge port and a base plate provided at one longitudinal end of said bowl, at least one outlet opening provided in said base plate and a liquid phase discharge port member placed over the at least one outlet opening. The invention further relates to a liquid phase discharge port member adapted to be placed over an outlet opening of a rotating machine.

A rotating machine from this type is known from U.S. Pat. No. 7,022,061 which has a tubular outlet member with an elbow bend in opposite direction of bowl rotation. A similar rotating machine is described in US 2004/072668 and describes a casing provided with a nozzle in the casing side. Above the casing a weir may be provided. The liquid discharge has an angle with the base plate. However the nozzle in certain applications of such a machine tends to clog and thus the liquid will flow by overflow which can increase power consumption.

Another rotational machine, especially a centrifugal separator, is described in WO 2008/138345. Here a casing is also provided with a discharge opening in an angle to the base plate. The pond level is generated by a weir with an overflow edge. This weir operates similar to the weirs known from e.g. U.S. Pat. No. 4,575,370 with the only difference that the flow is in a direction where it cannot clinge to the outside of the base plate.

The separator of the above-mentioned WO 2008/138345 seems to solve the problem of U.S. Pat. No. 4,575,370. However there is an uncontrolled flow of the liquid in radial direction and low liquid acceleration at the outlet compared with U.S. Pat. No. 4,575,370.

The present invention therefore aims at providing a rotational machine and a liquid phase discharge port member for such rotational machine that eliminates or reduces the problems mentioned above and wherein the power recovery is improved.

SUMMARY OF THE INVENTION

A rotating machine comprises, in accordance with the present invention, a bowl rotatable about an axis to generate a cylindrical pool of a feed slurry, said bowl having a heavy phase discharge port and a base plate provided at one longitudinal end of said bowl, at least one outlet opening provided in said base plate and a liquid phase discharge port member placed over the at least one outlet opening.

The invention is characterised by said liquid phase discharge port member including at least one open straight channel with a longitudinal axis, wherein the longitudinal axis of said channel extends at an acute angle relative to said base plate and said channel has an extension in the direction of said longitudinal axis. With this extension the flow of the liquid is directed by the channel at an acute angle to the base plate more or less in circumferential direction and the reaction forces may be used to rotate the bowl, thus reducing the energy consumption considerably.

With the length of said channel being between 0.1 and 5 times, advantageously between 1 and 3 times, the width the flow can be directed to the intended direction more securely.

If an additional closed channel is arranged radially outwardly with respect to said at least one channel having a longitudinal axis arranged parallel to said longitudinal axis of said at least one channel there is an additional source of energy recovery.

When the length of said closed channel is approximately equal to the length of said channel the flow of both streams is in an approximately similar direction and thus not disturbing each other.

If a nozzle member is placed at the end of said closed channel the flow can even be better directed into a desired direction and due to the high velocity of the flow an even higher energy recovery is possible. In case that the nozzle is clogged the liquid will discharge by the open channel with low increase in power consumption.

A further improvement is given when said nozzle member is adjustable and/or exchangeable. So the liquid flow can be adjusted to the desired production.

Further if slots or other mechanical solutions are provided in said liquid phase discharge port member to adjust said liquid phase discharge port member in radial direction, the level in the bowl can easily be changed.

A further object of the invention is to provide a liquid phase discharge port member adapted to be placed over an outlet opening of a rotating machine. The liquid phase discharge port member, according to the invention comprises a flange, an inlet opening provided in said flange. The invention is characterised by said liquid phase discharge port member including an open straight channel with a longitudinal axis, wherein the longitudinal axis of said channel extends at an acute angle relative to said flange and said channel has an extension in the direction of said longitudinal axis. With this extension the flow of the liquid is directed by the channel at an acute angle to the base plate more or less in circumferential direction and the reaction forces may be used to rotate the bowl, thus reducing the energy consumption of a rotating machine, e.g. centrifuge, considerably.

Preferably said liquid phase discharge port member has a length of said channel being equal or more than the width so the flow can be directed to the intended direction more securely.

If said liquid phase discharge port member has additional tubular opening arranged below a bottom of said channel having a longitudinal axis arranged parallel to said longitudinal axis of said channel there is a second source for energy recovery.

It is of advantage when the length of said tubular opening is approximately equal to the length of said channel so the flow of both streams is in an approximately similar direction and thus not disturbing each other.

A further improvement is characterised by a nozzle member being placed at the end of said tubular opening, whereby said nozzle member may be adjustable and/or exchangeable. If a nozzle member is placed at the end of said tubular opening the flow can even be better directed into a desired direction and due to the high velocity of the flow an even higher energy recovery is possible and by the adjustable and/or exchangeable nozzle member the liquid flow can easily be adjusted to the desired production of the rotating machine, e.g. centrifuge.

If the liquid phase discharge port member according to the invention has slots to adjust said liquid phase discharge port member with respect to said outlet opening of said rotational machine, the level in the bowl of said rotational machine, e.g. centrifuge, can easily be changed.

BRIEF DESCRIPTION OF THE DRAWINGS

The invention will now be described in further details based on exemplary, but not limiting, embodiments with reference to the drawings. In the drawings.

DETAILED DESCRIPTION

Figure 1:
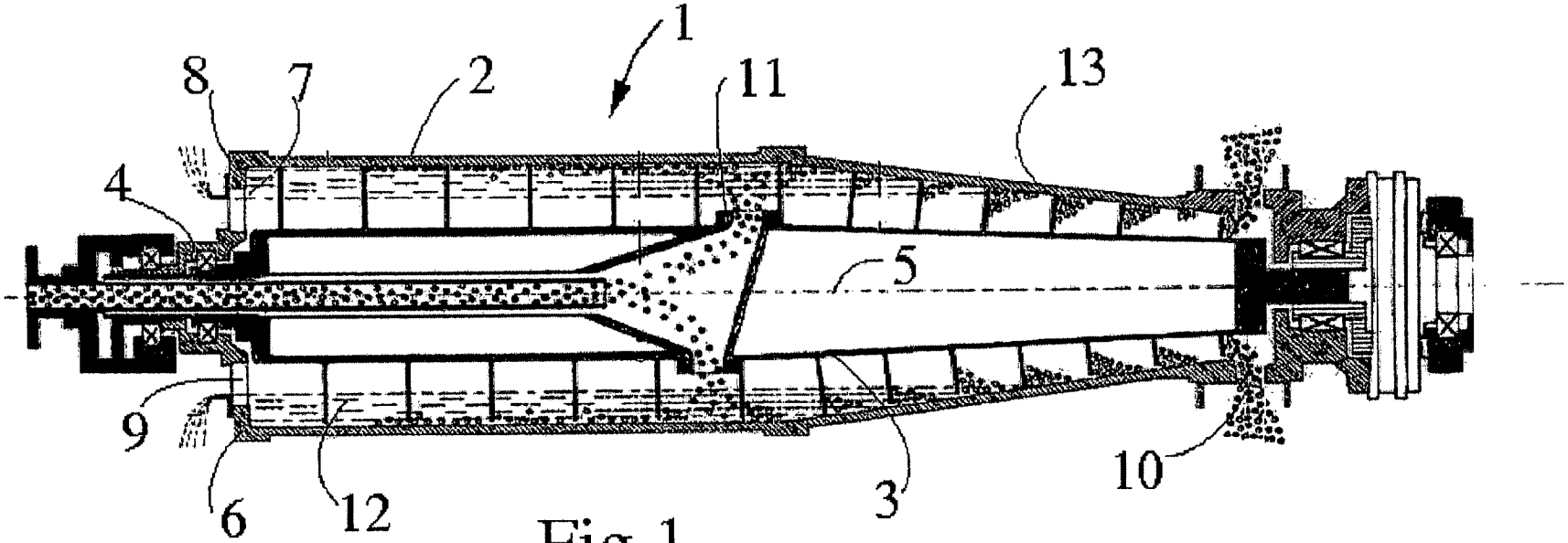
FIG. 1 shows a schematic view of a rotational machine, e.g. a decanter centrifuge, of prior art.

FIG. 1 shows a prior art decanter centrifuge 1 which comprises a bowl and a screw conveyor 3 which are mounted on a shaft 4 such that they in use can be brought to rotate around an axis 5 of rotation, the axis 4 of rotation extending in a longitudinal direction of the bowl 2. The bowl 2 comprises further a base plate 6 provided at one longitudinal end of the bowl 2, which base plate 6 has an internal side 7 and an external side 8. The base plate 6 is provided with a number of liquid phase outlet openings 9. Furthermore the bowl 2 is at an end opposite to the base plate 6 provided with solid phase discharge openings 10.

Further the screw conveyor 3 comprises inlet openings 11 for feeding e.g. slurry to the centrifugal separator 1, the slurry comprising a light or liquid phase 12 and a heavy or solid phase 13. During rotation of the centrifugal separator 1, separation of the liquid 12 and solid 13 phases is obtained. The liquid phase 12 is discharged through the outlet openings 9 in the base plate 6, while the screw conveyor 3 transports the solid phase 13 towards the solid phase discharge openings 10 through which the solid phase 13 is discharged.

Figure 2A:
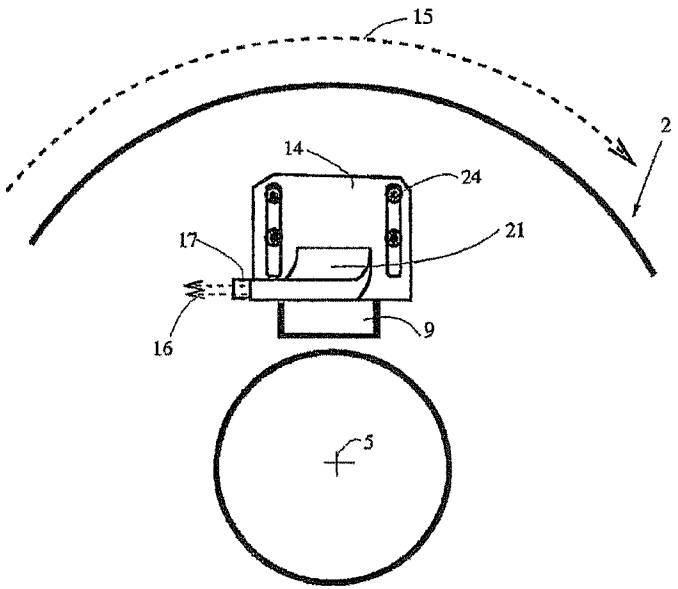
FIG. 2A shows a section of the base plate at the end of a rotational machine, equipped with liquid phase discharge members of one embodiment according to the invention.
Figure 2B:
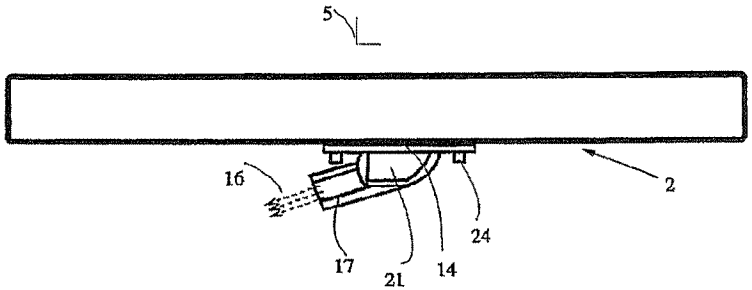
FIG. 2B shows a top view on FIG. 2A.

FIG. 2A shows a view to a section of the base plate 6 with mounted with a liquid phase discharge member 14 and fixed with bolts 24 according to one embodiment of the invention. Also the direction of rotation 15 of the bowl 2 is shown. Further it can be seen that the direction 16 of the liquid flow is essentially in opposite direction to the direction of rotation 15. However there is a component also in direction of the axis 5 of rotation, which leads to a better flow not interfering with other liquid phase discharge members. This can be seen from FIG. 2B.

Figure 3:
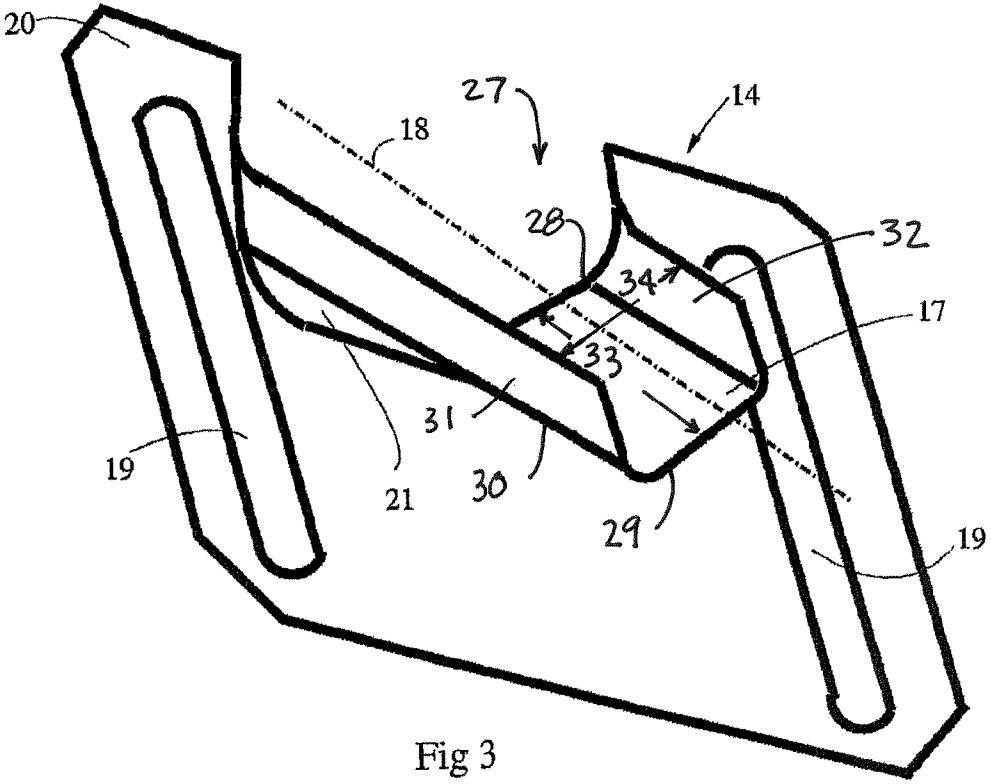
FIG. 3 shows a view of a liquid phase discharge member of one embodiment according to the invention.

FIG. 3 shows a view of liquid phase discharge member 14 with an open straight discharge channel 17. Here the channel 17 can be seen with its longitudinal axis 18. As observed in a top view from the base plate, channel 17 is covered only at three sides, i.e. it is open on top 27 and unrestricted at the inlet end 28 and outlet or discharge end 29. In particular, the open channel 17 consists of a bottom 30 and two straight, parallel sides 31, 32. This establishes the open top 27, and the unrestricted inlet end and unrestricted discharge end. So there is no risk of clogging or similar closing of the channel 17. Further there can be seen slots 19 in flange 20 which allow to adjust the liquid phase discharge member 14 to a specific level in the bowl. However there can be other mechanical solutions for fixing the flange 20 to the base plate 6. Further this allows to mount it on different types or sizes of rotational machines or centrifugal separators. Further there is shown a transition region defining a progressive reduction 21 in flow path area immediately before channel 17. As also shown in FIG. 4, the transition region has an open top. Both sides 31, 32 of the channel 17 are distinct from the flange, and the channel 17 is spaced from the flange by an intermediate flow path defined by the transition region. This progressive reduction for the liquid when it is approaching the channel leads to a low liquid pressure loss. Also channel 17 may have a cross section in U-form, half circle, or any other appropriate form that confines the flow with open top. The length 33 of the open channel extends 0.1 to 5 times the width 34.

Figure 4A:
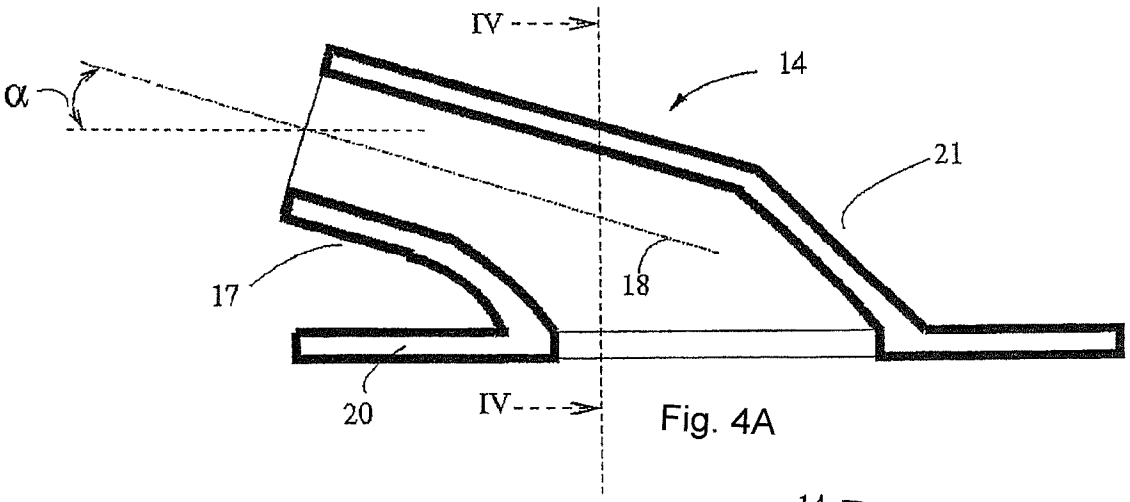
FIG. 4A shows a top view of a liquid phase discharge members of one embodiment according to FIG. 3.
Figure 4B:
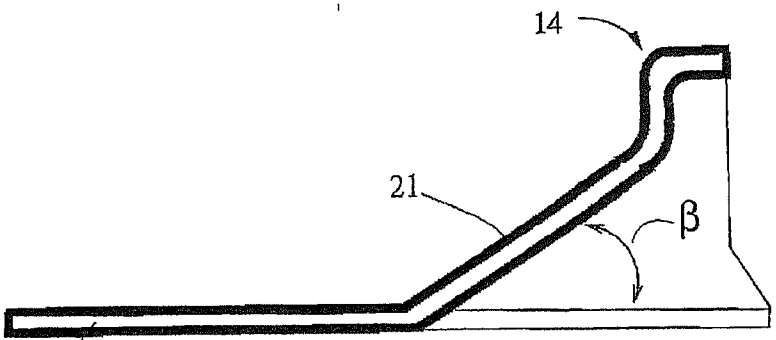
FIG. 4B shows a section along lines IV-IV in FIG. 4A.
Figure 5A:
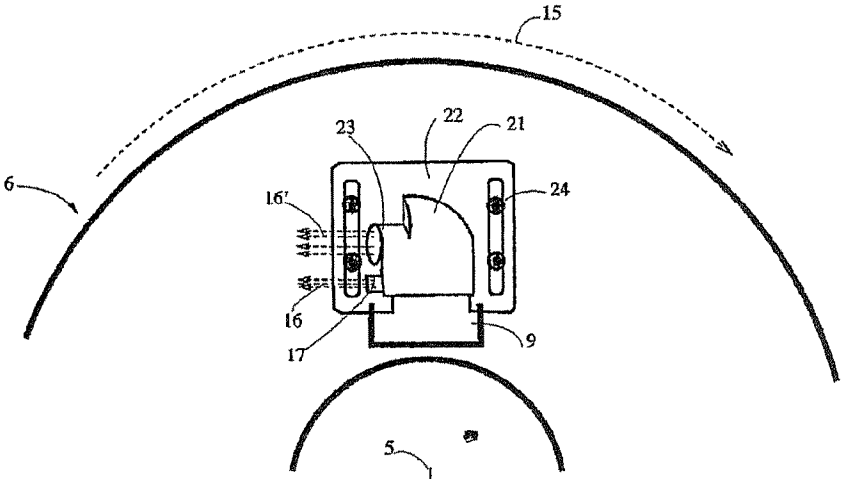
FIG. 5A shows the base plate at the end of a rotational machine, equipped with liquid phase discharge members of another embodiment according to the invention.
Figure 5B:
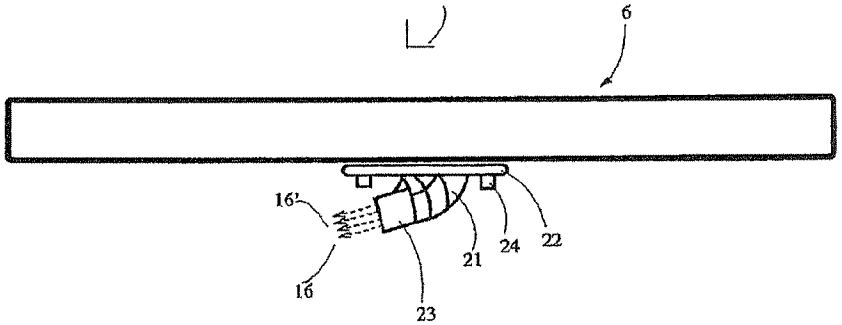
FIG. 5B shows a top view on FIG. 5A.

In FIG. 4A top view to the liquid phase discharge member 14 is shown. Here clearly angle $\alpha$ between the flange 20 and the longitudinal axis 18 of channel 17 can be seen. Angle $\alpha$ may be in the range of 1-35°, more preferably between 10 and 20°, with a preferred value of 15°. Flange 20 may be rectangular (as shown), circular or of other shape. FIG. 4B shows a section along line IV-IV in FIG. 4A where a rise of wall 21 of flange 20 at an angle $\beta$ can be seen. Angle $\beta$ may be in the range of 1-80°, more preferably between 25 and 45°, specifically approximately 35°. This rise of the wall 21 creates a progressive reduction when the liquid is approaching the channel. Thus the liquid pressure loss is not high. With this pressure drop reduction the liquid speed does not decrease too much at the beginning of the channel. Therefore this leads to a high speed at the end of the channel and an increased power reduction. FIG. 5A shows a view to a base plate 6 similar to FIG. 2A but with a liquid phase discharge member 22 according to another embodiment of the invention. Again the direction of rotation 15 is shown and the flow 16 and 16' of the liquid in opposite direction to the direction of rotation 15. Through the closed channel 23, which is arranged outwardly from the axis 5 with respect to channel 17, there is a second flow 16'. Again there is a component also in direction of the axis 5 of rotation, which can be seen in the top view in FIG. 5B.

Figure 6:
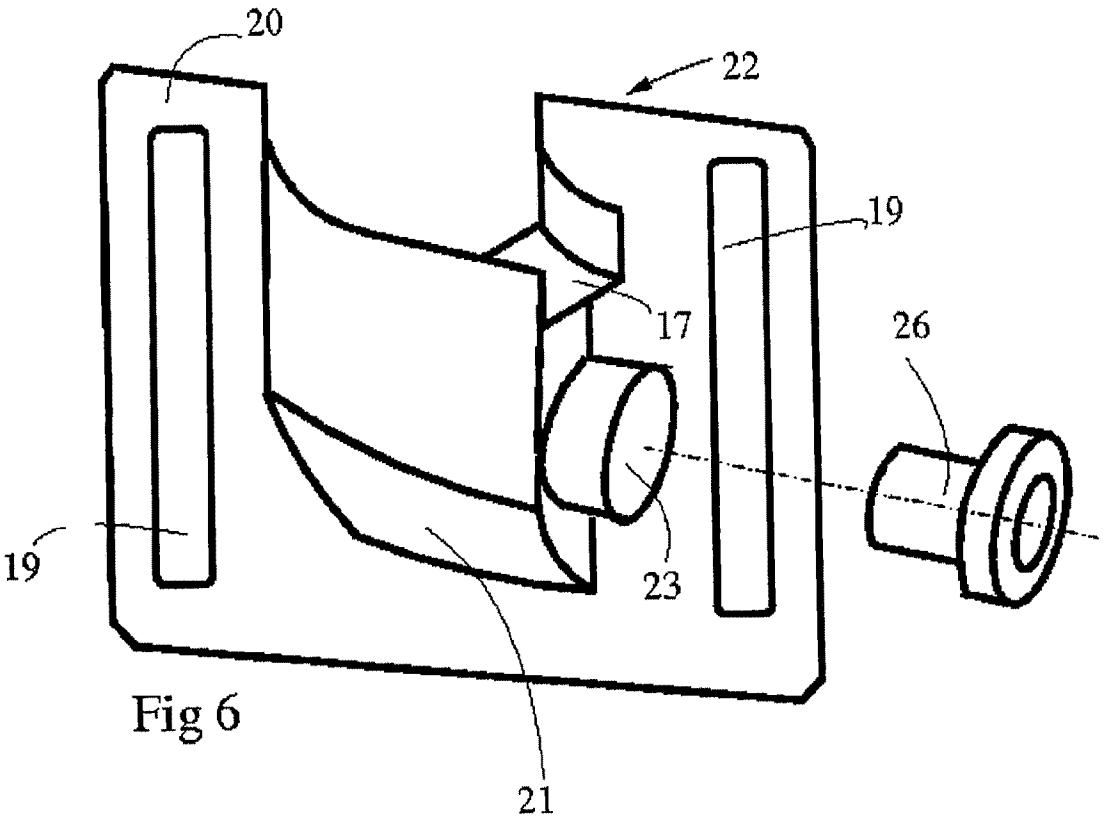
FIG. 6 shows a 3D view of a liquid phase discharge members according to FIG. 5.

In FIG. 6 a view of an embodiment of a liquid phase discharge member 22 according to the invention is shown. This liquid phase discharge member 22 consists of a flange 20, which may be rectangular (as shown), circular or of other shape, with slots 19 through which screws 24 are mounted to the base plate 6 of the bowl 2. There is an open straight channel 17 which directs the flow in an angle away from base plate 6. Below it, which also refers to the level of the fluid in the bowl, a closed channel 23 is arranged. The closed channel 23 can be adjusted or equipped with an exchangeable nozzle 26 with another open diameter to be adapted to different volumes of flow. The flow of the centrate of the rotating machine, e.g. decanter centrifuge can be at a ratio of 10 to 90 up to 70 to 30 of flow through the channel 17 to flow through nozzle 23 in normal operation but may go up to 100 to 0 if especially all nozzles are clogged. Preferred is a ratio of less than 50 to 50, as this allows a better directed flow and a higher velocity leading to a higher amount of energy recovered.

Figure 7:
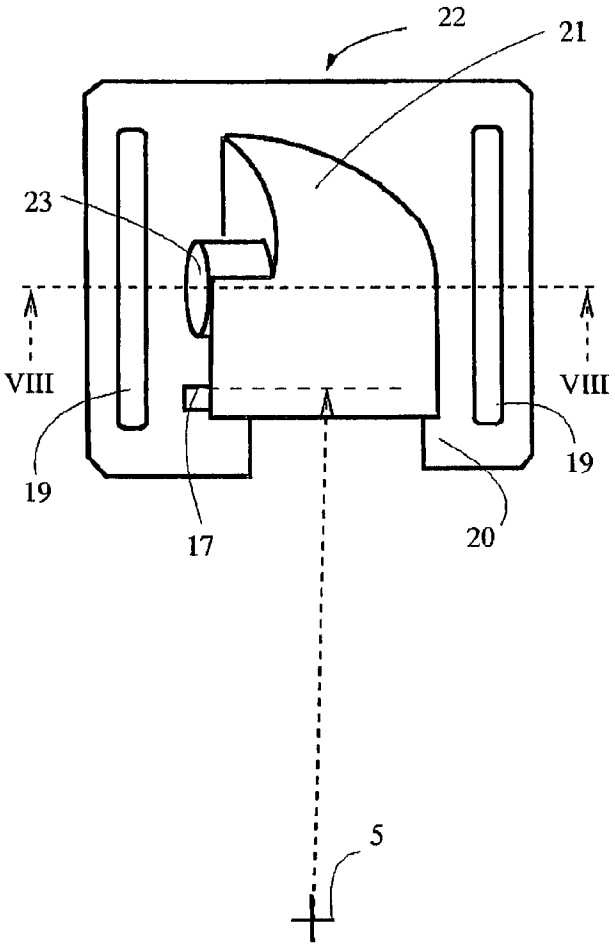
FIG. 7 shows a front view of a liquid phase discharge members according to FIG. 5.

FIG. 7 shows a drawing of the liquid phase discharge member 22 with slots 19 arranged in flange 20. Open straight 17 can be seen with its outlet opening and further closed channel 23, which might have a tubular, rectangular, polygonal or other cross section, can be seen. As the opening of closed channel 23 (and open straight channel 17) can be seen, it is clear that these are in an angle to the plane of the flange 20.

Figure 8:
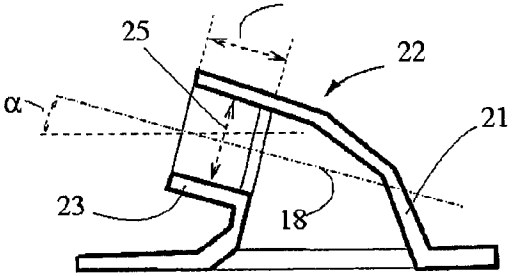
FIG. 8 shows a section through lines VIII-VIII in FIG. 7

FIG. 8 shows a section through liquid phase discharge member 22 along line VIII-VIII in FIG. 7. The diameter 25 of (shown) tubular closed channel 23 corresponds to the width of open straight channel 17 and the central axis of closed channel 23 is accordingly in the direction of the longitudinal axis 18 of channel 17 and encloses an angle $\alpha$ to flange 20. The length 24 of closed channel 23 is in the range of between 0.1 and 5 times the diameter or width, most favourably at 1 to 2 times.

Figure 9:
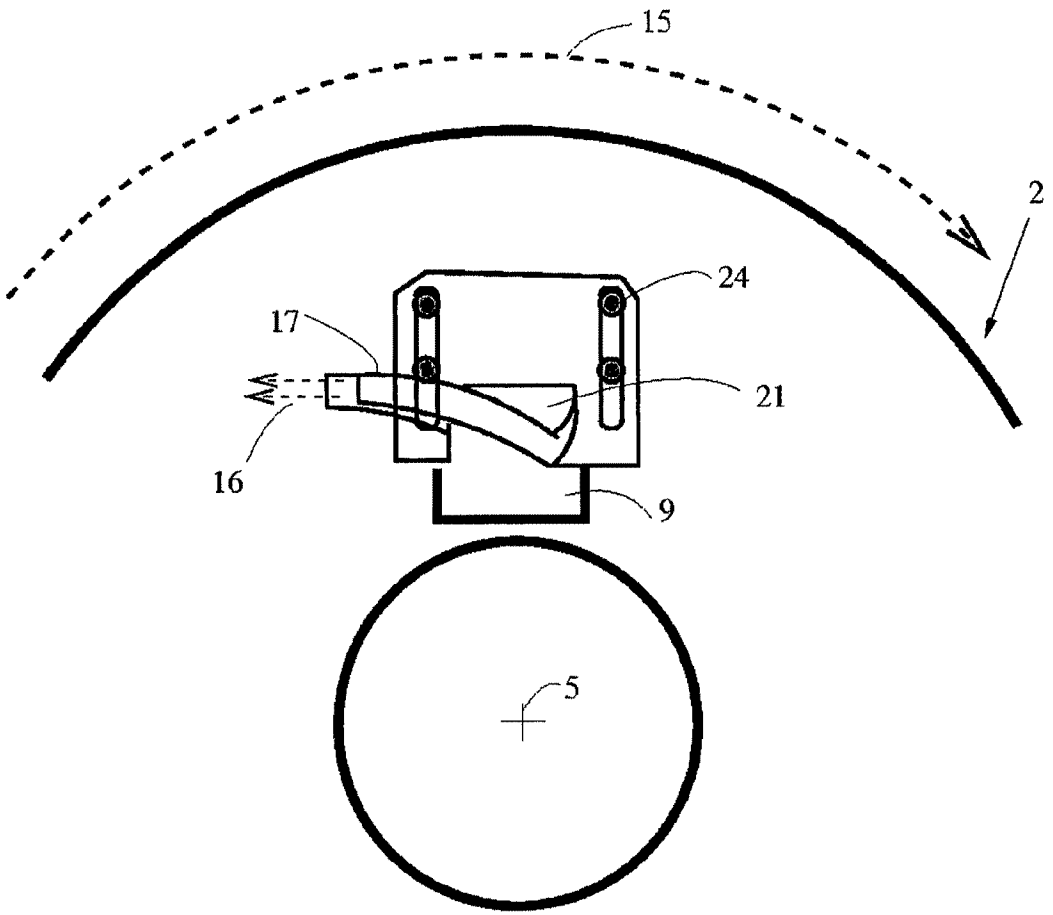
FIG. 9 shows a third embodiment of a liquid phase discharge member according to the invention.

FIG. 9 shows another embodiment of a liquid phase discharge port similar to FIG. 2A. However here the channel 17 is curved.

From FIGS. 5A, 5B, 6, 7, 8 and 9 it can be seen that the progressive reduction for the liquid when it is approaching the channel can have various shapes. The main effect of this progressive reduction is that the liquid pressure loss is not high.

In general liquid discharge phase port 14, 22 is provided with two parts. One part has a progressive restriction 21 until the channel(s) 17, 23. The other part includes at least one open channel 17 or closed channel 23 with or without nozzle.

Although the invention has been described in terms of particular embodiments, it is not limited to these examples but can be other embodiments within the scope of the claims. For example the cross section of the channels may have all kind of shapes.

The invention claimed is:

1. A decanter centrifuge, comprising:

a bowl rotatable about a rotation axis to generate a cylindrical pool of a feed slurry, said bowl having a heavy phase discharge port;

a base plate provided at one longitudinal end of said bowl;

an outlet opening provided in said base plate; and a liquid phase discharge port member placed over the outlet opening;

wherein said liquid phase discharge port member includes a flange with an inlet opening aligned with said outlet opening and a flow path leading from said inlet opening to an open straight discharge channel that extends along a straight longitudinal axis, which axis extends at an acute angle relative to said base plate; and as viewed from said base plate, said open channel consists of a bottom and two straight parallel sides that are distinct from said flange, and has an open top, and an unrestricted inlet end and an unrestricted discharge end.

2. A decanter centrifuge according to claim 1, wherein the length of said open channel extends 0.1 to 5 times the width.

3. A decanter centrifuge according to claim 1, further comprising an additional, closed channel arranged radially outwardly with respect to said open channel wherein said additional channel has another, straight longitudinal axis arranged parallel to said longitudinal axis of said open channel.

4. A decanter centrifuge according to claim 3, wherein the length of said closed channel is substantially equal to the length of said open channel.

5. A decanter centrifuge according to claim 3, further comprising a nozzle member disposed at a discharge end of said closed channel.

6. A decanter centrifuge according to claim 5, wherein said nozzle member is adjustable or exchangeable.

7. A decanter centrifuge according to claim 1, wherein said open channel is spaced from said flange and said flow path of the liquid phase discharge port member includes a progressive reduction in flow area through said space before the flow enters said open channel.

8. A decanter centrifuge according to claim 1, further comprising slots disposed in said flange of said liquid phase discharge port member to adjust said liquid phase discharge port member in radial direction on said base plate.

9. A liquid phase discharge port member for an outlet opening in a base plate of a decanter centrifuge, comprising:

a flange;

an inlet opening provided in said flange;

a flow path leading from said inlet opening to an open straight discharge channel with a longitudinal axis;

wherein the longitudinal axis of said open channel extends at an acute angle relative to said flange and said open channel extends in the direction of said longitudinal axis; and wherein as viewed from said base plate, said open channel consists of a bottom and two straight, parallel sides that are distinct from said flange, and has an open top, and an unrestricted inlet end and an unrestricted discharge end.

10. A liquid phase discharge port member according to claim 9, wherein the length of said open channel extends 0.1 to 5 times the width.

11. A liquid phase discharge port member according to claim 9, further comprising an additional, closed channel having a longitudinal axis arranged parallel to said longitudinal axis of said open channel.

12. A liquid phase discharge port member according to claim 11, wherein the length of said closed channel is approximately equal to the length of said open channel.

13. A liquid phase discharge port member according to claim 11, further comprising a nozzle member at a discharge end of said closed channel, which nozzle member is adjustable or exchangeable.

14. A liquid phase discharge port member according to claim 9, wherein said channel is spaced from said flange and said flow path of said liquid phase discharge port member includes a progressive reduction in flow area in said space, between said inlet opening in said flange and said open channel.

15. A liquid phase discharge port member according to claim 9, further comprising slots in said liquid phase discharge port member to adjust said liquid phase discharge port member with respect to said outlet opening of said rotational machine.

16. A decanter centrifuge according to claim 5, wherein said nozzle member is adjustable and exchangeable.

17. A decanter centrifuge according to claim 3, wherein said flow path of the liquid phase discharge port member leads to said open channel and to said closed channel and said flow path includes a progressive reduction in flow area immediately before said open channel and said closed channel.

18. A liquid phase discharge port member according to claim 9, further comprising an additional, closed channel extending along another longitudinal axis arranged parallel to said longitudinal axis of said open channel;

an open-top transition region between said opening in the flange and said channels, defining a progressive reduction in flow area leading immediately into said open channel and said closed channel; and a nozzle member at a discharge end of said closed channel, which nozzle member is adjustable or exchangeable.

19. A decanter centrifuge according to claim 7, wherein the progressive reduction in flow area through said space before the flow enters said open channel has an open top.

20. A liquid phase discharge port member according to claim 14, wherein the progressive reduction in flow area through said space before the flow enters said open channel has an open top.

* * * * *